US006731059B2

(12) United States Patent
Piejak

(10) Patent No.: US 6,731,059 B2
(45) Date of Patent: May 4, 2004

(54) MAGNETICALLY TRANSPARENT ELECTROSTATIC SHIELD

(75) Inventor: Robert B. Piejak, Wayland, MA (US)

(73) Assignee: Osram Sylvania Inc., Danvers, MA (US)

( * ) Notice: Subject to any disclaimer, the term of this patent is extended or adjusted under 35 U.S.C. 154(b) by 9 days.

(21) Appl. No.: 10/059,446

(22) Filed: Jan. 29, 2002

(65) Prior Publication Data

US 2003/0141801 A1 Jul. 31, 2003

(51) Int. Cl.[7] ..... H01J 1/62
(52) U.S. Cl. ..... 313/493; 313/46; 313/161
(58) Field of Search ..... 313/493, 46, 161

(56) References Cited

U.S. PATENT DOCUMENTS 4,727,295 A 2/1988 Postma et al. ..... 315/248
5,325,018 A 6/1994 El-Hamamsy et al. ..... 315/85
5,541,482 A * 7/1996 Siao ..... 315/248
5,619,103 A * 4/1997 Tobin et al. ..... 315/111.21
5,726,523 A 3/1998 Popov et al. ..... 313/161
6,056,848 A 5/2000 Daviet ..... 156/345
6,149,760 A * 11/2000 Hama ..... 156/345.48
6,499,424 B2 * 12/2002 Kazumi et al. ..... 118/723 I
6,518,705 B2 * 2/2003 Wilcoxson et al. ..... 315/111.51
6,523,493 B1 * 2/2003 Brcka ..... 118/723 I

* cited by examiner

*Primary Examiner*—Nimeshkumar D. Patel
*Assistant Examiner*—Holly Harper
(74) *Attorney, Agent, or Firm*—Carlo S. Bessone

(57) ABSTRACT

An inductively-coupled, electrodeless fluorescent lamp comprises a lamp body having two opposed sides; an induction coil on one side of said body; and a magnetically transparent electrostatic shield interposed between said induction coil and said one side of said body, said shield comprising an insulating substrate; an electrically conductive layer on said substrate including means for reducing capacitive coupling between a voltage on said induction coil and a plasma discharge within said lamp body, said electrically conductive layer having a thickness between 400 Å and 1000 Å, inclusive.

3 Claims, 3 Drawing Sheets

MAGNETICALLY TRANSPARENT ELECTROSTATIC SHIELD

TECHNICAL FIELD

This invention relates to fluorescent lamps and more particularly to electrodeless, inductively coupled, low-pressure fluorescent lamps. Still more particularly, it relates to a shield having reduced electrostatic coupling between a high voltage source and the lamp.

BACKGROUND ART

Inductively coupled, low-pressure fluorescent lamps are known and are commercially available. These lamps provide high efficacy, long life and high lumen output. However, current electrodeless lamps operate in the frequency band near 2.6 MHz and have been limited to a re-entrant cavity configuration primarily due to common mode electromagnetic interference (emi) regulations. (In the United States these regulations are promulgated by the Federal communications Commission). EMI occurs when voltage applied to an induction coil capacitively couples to the discharge (which is maintained by the current flowing through the induction coil). Various shields have been successfully applied to reduce emi. Such shields are shown in U.S. Pat. Nos. 4,727,295; 5,325,018; and 5,726,523. These patents all disclose Faraday shields that reduce emi for a 2.65 MHz induction lamp wherein the lamps are low-pressure discharge lighting and have in common a geometrical configuration wherein a solenoidal induction coil that drives the discharge is located within a re-entrant cavity. In this geometry the shield material is primarily parallel to the magnetic filed lines and attenuation of the time varying magnetic flux is relatively limited as long as the shield does not form a closed loop that surrounds the flux enclosed by the solenoid. A large part of the magnetic flux, which induces the electric field that maintains the discharge, does not encounter the shield material and thus limits on shield thickness are not very stringent. The aforementioned U.S. Pat. No. 4,727,295 mentions a shield thickness of 0.25 mm ($2.5\times10^6$ angstroms, hereinafter, Å). U.S. Pat. No. 5,726,523 suggests a thickness of 1 mm ($10^7$ Å); while U.S. Pat. No. 5,325,018 does not define a shield thickness except to say it may be very thin. U.S. Pat. No. 6,056,848 discusses a "thin" shield for a plasma reactor used for processing semiconductor substrates, such shields having a preferred thickness between 0.1 micron and 5 microns.

A shield based on the principles disclosed in the first three patents is limited to use with a solenoidal coil within a re-entrant cavity, thus having the practical effect of restricting most inductively coupled lamps driven at 2.65 MHz to a re-entrant geometry configuration.

DISCLOSURE OF INVENTION

It is, therefore, an object of this invention to obviate the disadvantages of the prior art.

It is another object of the invention to enhance the operation of electrodeless fluorescent lamps.

Yet another object of the invention is the provision of a method of operating an external coil electrodeless fluorescent lamp (ECEFL) with increased efficacy.

These objects are accomplished, in one aspect of the invention, by the provision of an inductively-coupled, electrodeless fluorescent lamp comprising: a lamp body having two opposed sides; an induction coil on one side of said body; and a magnetically transparent electrostatic shield interposed between said induction coil and said one side of said body, said shield comprising an insulating substrate; an electrically conductive layer on said substrate including means for reducing capacitive coupling between a voltage on said induction coil and a plasma discharge within said lamp body, said electrically conductive layer having a thickness between 400 Å and 1000 Å, inclusive.

While this shield can be used in a re-entrant cavity lamp, its primary appeal is that it can be used with an induction coil of virtually any geometry that is external to a discharge vessel, which discharge vessel can also have virtually any geometric configuration.

A method of increasing the efficiency of an inductively-coupled, electrodeless fluorescent lamp is also provided. The method comprises the steps of; providing a lamp body having two opposed sides; positioning an induction coil on one side of said body; and positioning a magnetically transparent electrostatic shield between the induction coil and the one side of the body. The shield comprises an insulating substrate and has an electrically conductive layer thereon. The substrate including means for reducing radio frequency capacitive coupling between a voltage on said induction coil and a plasma discharge within the lamp body. The electrically conductive layer has thickness between 400 Å and 1000 Å, inclusive. The lamp is operated by inducing an operating voltage on the lamp through the induction coil.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
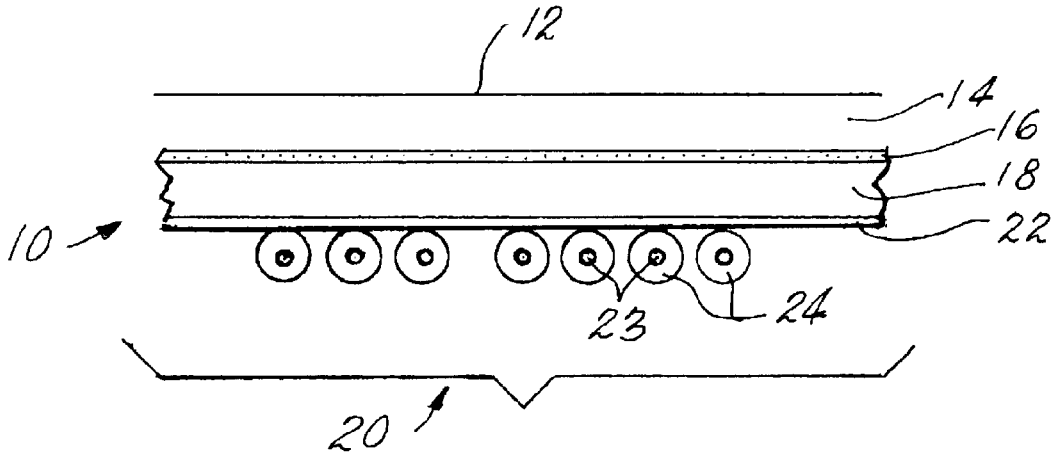
FIG. 1 is a diagrammatic elevational view, partially in section, illustrating the invention.

Referring now to the drawings with greater particularity, there is shown diagrammatically in FIG. 1 an operating vessel 10, which can be a low pressure, inductively coupled fluorescent lamp, and having a plasma discharge 12 above a sheath 14, a phosphor 16 and a glass envelope 18. An induction coil 20 is positioned adjacent one side of the glass envelope and a shield 22 is intimately interposed between the glass envelope 18 and coil 20. The coil 20 is composed of electrical conductors 23 surrounded by insulating material 24.

Being in such close proximity to the induction coil, the amount of magnetic flux that penetrates the shield (for the same induced voltage) is considerably greater than in the case of a re-entrant cavity. Additionally, many of the field lines are directed normal to the plane of the shield rather parallel to it as in the case of a re-entrant cavity. With the shield so near the coil, the shield cross sectional surface must have thin cuts in it, directed normal to the direction of current flow in the coil in order to reduce eddy currents. To maintain adequate electrostatic screening these cuts must be thin. To keep eddy currents (and magnetic attenuation) small, the shield thickness also must be ultra thin. Thus, the shield must, in general, be much thinner than a shield for a re-entrant cavity geometry. The shield thickness should be thick enough that the surface resistance is small with respect to the capacitive impedance between the coil and the shield, and it should be thin enough that eddy currents are small. It has been found that a metal film layer between about 400 Å-1000 Å, inclusive, (see Table I) will work for a lamp operated at 2.65 MHz. If the shield is thicker it attenuates the magnetic field strongly, which could result in excessive power loss in the shield. If the shield is thinner, its surface resistance is too high to provide adequate screen electrostatic screening. Thus, there is a relatively narrow range of shield thickness that results in a practical shield.

Using the electrostatic screen disclosed hereinafter, it is possible to make induction lamps with geometrical configurations not previously considered because there was no unobtrusive, inexpensive and efficient way to remove the common mode interference from the lamp body.

The only external coil lamp presently available on the open market is totally enclosed by a metal plate and a wire screen to reduce emi; but this is impractical for most applications.

Figure 2:
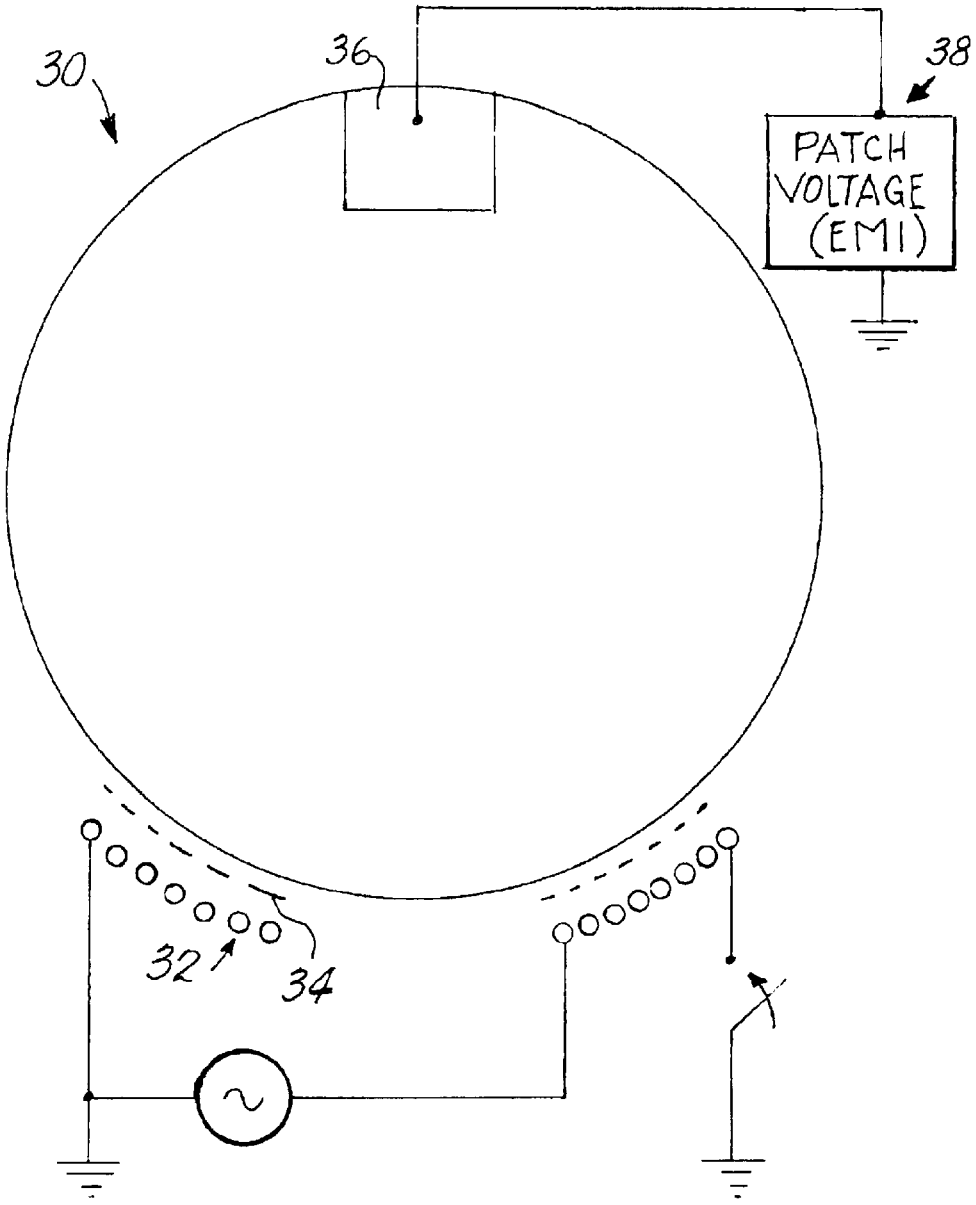
FIG. 2 is a diagrammatic view of an embodiment of the invention employed with a spherical lamp.
Figure 3:
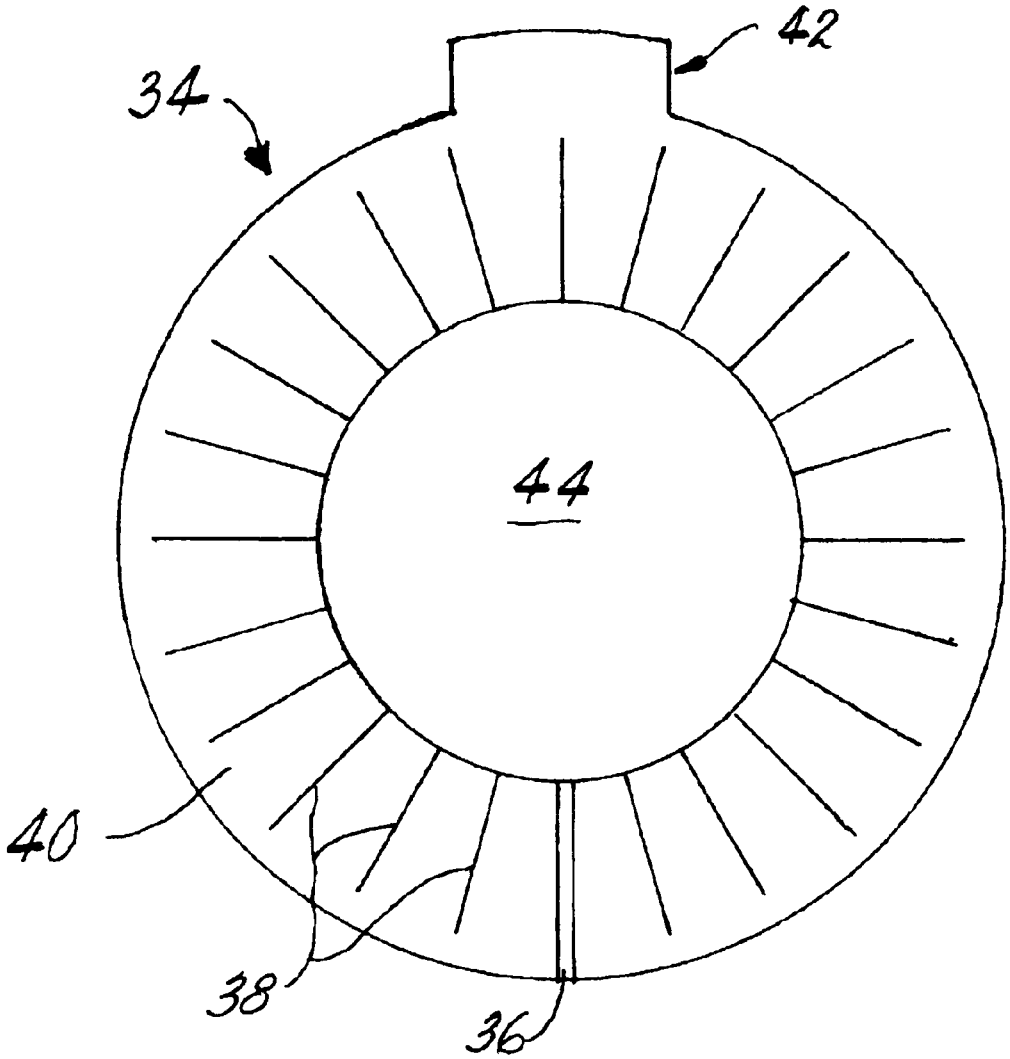
FIG. 3 is a plan view of the shield used with the lamp of FIG. 2.

Referring now to FIG. 2, one preferred embodiment of the inventive shield technique is shown. Herein, a spherical lamp 30 has an OD of 12.5 cm and will run with 80 W dissipated in the discharge. The induction coil 32 comprises 11 turns of #18, Teflon insulated wire. The shield 34 comprises a 400 Å thick aluminum coating on a paper backing. A 1.5"×1.5" copper foil patch 36 is attached to the top of the lamp and the RF voltage on the patch is measured via circuit 38. This voltage is a direct measurement of RF coupling between the induction coil and the discharge. A plan view of the shield 34 is shown in FIG. 3. A preferred substrate material would be a polyamide or Mylar; however, as shown from the example above, paper will work. The electric field lines from the windings of the coil terminate on the shield rather than in the discharge, as would be the case in the absence of the shield.

There is one full cut 36 in the shield so that the shield does not form a closed conducting path near the induction coil and significantly reduce its inductance and dissipate considerable power. The lines 38 shown on the surface 40 of the shield 34 represent very thin, radially directed cuts in the metal layer exposing the insulating layer. These cuts further reduce eddy currents. A grounding tab 42 is provided opposite the full cut 36 to minimize the resistance to the current path to ground and to balance the shield (electrostatic) potential with respect to ground. Shield 34 is provided with an opening 44 in its center that corresponds to the ID of the coil, since additional shielding material within the ID of the coil serves no purpose and would increase coil losses slightly, with no purpose. In addition to providing its electrostatic shielding function, the shield 34 reflects light and reduces the loss of light that would occur if only the coil were present adjacent the glass envelope.

The relative shielding effectiveness of lamp 30 can be measured. With the shield 34 floating, the voltage on patch 36 was 75 volts. With the shield 34 grounded, the patch 36 voltage was 2 volts. Thus, the shield 34 provided about 31 dB of electrostatic shielding. This represents a significant reduction in current mode emi. The Q of the coil was measured with no shield and with a shield. With the lamp running at 80 W in the discharge, 2.3 W is dissipated in the induction coil with no shield. With a shield in place the coil loss increases to 3.3 W. While this may seem a rather large loss (~30%) it will be seen that, considering that the lamp discharge is dissipating a total of 80 W, the lamp losses in the induction coil really only increase from 2.8% to 4.1%, an acceptably small loss. Thus, the shield 34 performs adequate electrostatic shielding while resulting in minimal additional loss in the induction coil 32.

By utilizing the shielding techniques shown herein many other embodiments and sizes of light sources are possible. The ultimate shape of an actual lamp will depend mainly upon the lighting requirements and the imagination of the designer. All such embodiments have in common an induction coil external to the lamp and a shielding material sandwiched between the coil and the discharge envelope. In all embodiments the shield will have one full cut in the shield surface so as not to form a closed turn near the coil, along with many partial thin cuts about 2–3 mm apart to reduce eddy currents. In all cases the cuts are perpendicular to the direction of the coil windings. Increasing the density of the insulating cuts past this point is not productive because making the cuts not only takes time, it actually may reduce the electrostatic shielding without providing a practical reduction in eddy currents. A relative magnetic attenuation of less than about 0.1 dB is adequate.

Thus, an electrostatic screening technique is shown that reduces electrostatic coupling of an induction coil to a discharge that is induced by current through that coil. The shield is formed by an ultra thin metal film (i.e., 400 Å to 1000 Å) coated on a suitable insulating substrate to provide an inexpensive shield that is relatively invisible to the magnetic fields created by the induction coil. Also, operating the lamp by the method described above reduces the emi to an acceptable level with as little extra power loss as possible.

Table I illustrates the importance of the thickness and scoring of the metal layer in controlling the dB loss.

| Metal Thickness: kilo Å | DB loss - No scoring | DB loss - scored |
|---|---|---|
| Copper - 680 kÅ | 35.6 | 1.6 |
| Aluminum - 80 kÅ | 30.5 | — |
| Aluminum - 8 kÅ | 11.36 | — |
| Aluminum - 1 kÅ | 0.7 | 0.08 |
| Aluminum - 0.4 kÅ | 0.3 | 0.015 |

While there have been shown and described what are at present considered to be the preferred embodiments of the invention, it will be apparent to those skilled in the art that various changes and modification can be made herein without departing from the scope of the invention as defined by the appended claims.

What is claimed is:

1. An inductively-coupled, electrodeless fluorescent lamp comprising; a lamp body having two opposed sides; an induction coil on one side of said body; and a magnetically transparent electrostatic shield intimately interposed between said induction coil and said one side of said body, said shield comprising an insulating substrate; an electrically conductive layer on said substrate including means for reducing capacitive coupling between a voltage on said induction coil and a plasma discharge within said lamp body, said electrically conductive layer having a thickness between 400 Å and 1000 Å, inclusive.

2. The lamp of claim 1 wherein said means for reducing capacitive coupling comprises a plurality of slots in said electrically conductive layer.

3. A method of increasing the efficiency of an inductively-coupled, electrodeless fluorescent lamp comprising the steps of providing a lamp body having two opposed sides; positioning an induction coil on one side of said body; and intimately positioning a magnetically transparent electrostatic shield between said induction coil and said one side of said body, said shield comprising an insulating substrate; an electrically conductive layer on said substrate including means for reducing radio frequency capacitive coupling between a voltage on said induction coil and a plasma discharge within said lamp body, said electrically conductive layer having a thickness between 400 Å and 1000 Å, inclusive; and inducing an operating voltage on said lamp through said induction coil.

* * * * *